US005678712A

United States Patent [19]

Rios

[11] Patent Number: 5,678,712

[45] Date of Patent: Oct. 21, 1997

[54] CHILD RESISTANT REMINDER CLOSURE

[75] Inventor: Luz Rios, Oak Harbor, Ohio

[73] Assignee: Owens-Illnois Closure Inc., Toledo, Ohio

[21] Appl. No.: 451,613

[22] Filed: May 26, 1995

[51] Int. Cl.[6] ..... B65D 55/02

[52] U.S. Cl. ..... 215/220; 215/223; 215/230; 116/308; 206/534

[58] Field of Search ..... 215/204, 206, 215/217, 218, 219, 220, 223, 222, 230; 206/534; 116/308

[56] References Cited

U.S. PATENT DOCUMENTS

| | | | |
|---|---|---|---|
| 3,151,599 | 10/1964 | Livingston . | |
| 4,011,829 | 3/1977 | Wachsmann . | |
| 4,220,247 | 9/1980 | Kramer . | |
| 4,365,722 | 12/1982 | Kramer . | |
| 4,749,093 | 6/1988 | Trick . | |
| 5,009,338 | 4/1991 | Barker . | |
| 5,011,032 | 4/1991 | Rollman . | |
| 5,082,129 | 1/1992 | Kramer . | |
| 5,082,130 | 1/1992 | Weinstein . | |
| 5,092,477 | 3/1992 | Johnson, Jr. et al. | 215/220 X |
| 5,184,739 | 2/1993 | Kusz . | |
| 5,188,251 | 2/1993 | Kusz . | |

*Primary Examiner*—Allan N. Shoap
*Assistant Examiner*—Nathan Newhouse

[57] ABSTRACT

A child resistant reminder closure including an outer closure member having a base wall and a peripheral skirt, an inner closure member having a base wall and a peripheral skirt. A day disk is provided adjacent the inner surface of the base wall of the outer closure member. An indexing disk is provided adjacent the day disk. The day disk has a set of flexible radial ratcheting teeth extending radially outwardly from the day disk engagable with recesses on the indexing disk. A first set of rotationally interengagable lugs is provided between the outer closure member and the indexing disk. A second set of axially interengagable lugs are provided between the indexing disk and the inner closure member. The day disk has circumferentially spaced indicia thereon and the base wall of the outer closure member has an opening adapted to be selectively aligned with the indicia. Interengaging threads are provided on the inner closure member adapted to engage threads on a container by relative rotation of the inner closure member. When the outer closure member is moved axially to engage the inner closure member, the closure can be removed from a container. The day disk can be rotated relative to the outer closure member in one mode during application and in another mode during removal of closure to bring different indicia into view through the opening.

18 Claims, 9 Drawing Sheets

CHILD RESISTANT REMINDER CLOSURE

This invention relates to child resistant reminder closures.

BACKGROUND AND SUMMARY OF THE INVENTION

Regular use or maintenance of prescription drugs has become important in ensuring the health of users thereof and is being stressed and advocated by health authorities and governmental agencies such as the United States Food and Drug Administration. To comply with a regimen, it is helpful to remember when the person taking the medication last took the medication. One way of helping in this regard is to have a closure with a visual indicator of when the closure package was last opened or when the package should be opened next.

Current compliance closures use expensive battery operated indicators. Others use mechanical constructions that are complex and costly.

Typical closures of the mechanical type are shown in U.S. Pat. Nos. 3,151,599, 4,011,289, 4,365,722 and 5,009,338. Such closures have the disadvantage that they require axial movement between the reminder components. The axial movement between an outer closure member and an inner closure member of a child resistant closure would not permit such normal axial movement between the components of such reminder closures. In addition, relative axial movement and rotation between the reminder components can cause wear and obliteration of the indicia.

In accordance with U.S. Pat. No. 5,184,739, a child resistant reminder closure is shown including an outer closure member having a base wall and a peripheral skirt, an inner closure member having a base wall and a peripheral skirt with a bead on the outer closure member retaining the inner closure member against limited axial outward movement relative to the outer closure member. An assembly of a day disk and an indexing disk is provided on the outer closure member and is rotatable relative thereto. The day disk is provided adjacent the inner surface of the base wall of the outer closure member and is mounted on the underlying indexing disk. A first set of flexible radial ratcheting fingers extend radially outwardly from the day disk and engage circumferentially spaced lugs on the upper surface of the indexing disk. Interengagable lugs and recesses are provided on the inside of the back wall of the outer closure member and the top of indexing disk. Axially interengaging lugs and recesses are provided between the underside of the indexing disk and the inner closure member. These lugs are adapted to be interengaged to remove or apply the closure from a container thereby providing a child resistant feature. A window is provided on the outer closure member and is associated with indicia on the day disk to indicate the circumferential position of the outer closure member relative to the day disk.

In accordance with U.S. Pat. No. 5,188,251, a child resistant reminder closure comprises an outer closure member having a base wall and a peripheral skirt, an inner closure member having a base wall and a peripheral skirt with a bead on the outer closure member retaining the inner closure member for limited axial outward movement relative to the outer closure member. An indicator or a day disk is provided on the outer surface of the inner closure member and is rotatable relative to the outer and inner closure members. A first set of flexible radial ratcheting fingers extend radially from the indicator disk and engage radial lugs on the undersurface of the base wall of the outer closure member. A second set of flexible radial ratcheting fingers extend radially from the indicator disk and engage circumferentially spaced lugs on the upper surface of the inner closure member. Axially interengagable lugs are provided on the outer closure member and the inner closure member which are interengaged to remove the closure or to apply the closure to a container thereby providing a child resistant function. A window in the outer closure member is associated with the indicia on the day disk to indicate the circumferential position of the outer closure member relative to the day disk.

Among the objectives of the present invention are to provide a child resistant reminder closure of the type shown in U.S. Pat. No. 5,184,739 which can be more readily made and assembled and which can be readily made to function as a reminder closure during either removal or application of the closure to a container.

In accordance with the invention, the child resistant closure comprises an outer closure member having a base wall and a peripheral skirt, an inner closure member having a base wall and a peripheral skirt, and interengaging means between the outer closure member an inner closure member to retain the inner closure member against axially outward movement relative to the outer closure member. The outer closure member and said inner closure member have limited axial movement relative to one another. A day disk is provided adjacent the inner surface of the base wall of the outer closure member. An indexing disk is provided adjacent the day disk. The day disk has a set of flexible radial ratcheting teeth extending radially outwardly from the day disk. The indexing disk has recesses thereon engagable by the ratcheting teeth on the day disk. A first set of rotationally interengagable lugs is provided between the outer closure member and the indexing disk. A second set of axially interengagable lug means are provided between the indexing disk and the inner closure member. The day disk has circumferentially spaced indicia thereon, and the base wall of the outer closure member has an opening adapted to be selectively aligned with the indicia. Interengaging threads are provided on the inner closure member adapted to engage threads on a container by relative rotation of the inner closure member. When the outer closure member is moved axially to engage the inner closure member, the closure can be removed from a container and said day disk can be rotated relative to said outer closure member in one mode during application and in another mode during removal of closure to bring different indicia into view through the opening.

DESCRIPTION

Figure 1:
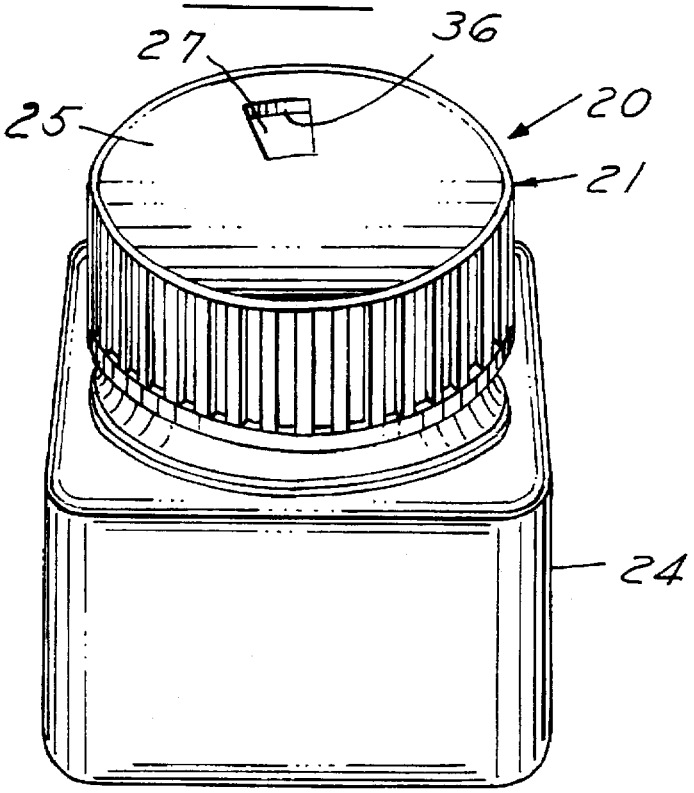
FIG. 1 is a perspective view of a child resistant package with a reminder closure.
Figure 2:
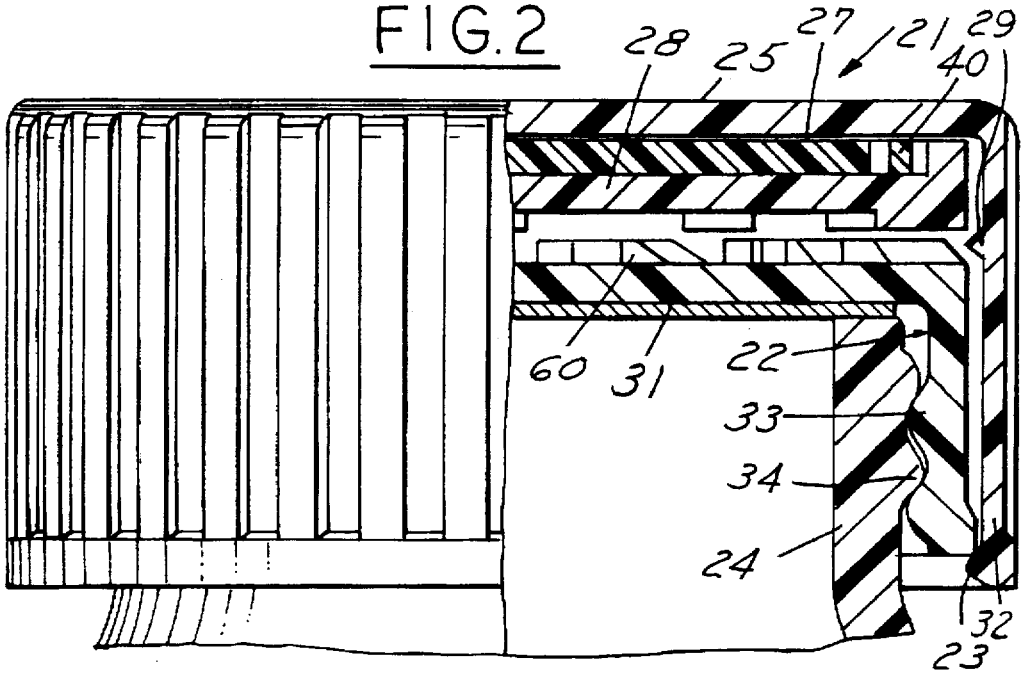
FIG. 2 is a part sectional view on a greatly enlarged scale showing the closure.

Referring to FIGS. 1 and 2, in accordance with the invention, the child resistant reminder closure 20 comprises an outer closure member 21 and an inner closure member 22 retained against limited axially outer movement by an annular bead 23. The closure 20 is adapted to be used with a container 24 having external threads 34 adapted to be engaged with the threads 33 of the closure member 22 as presently described.

Figure 3:
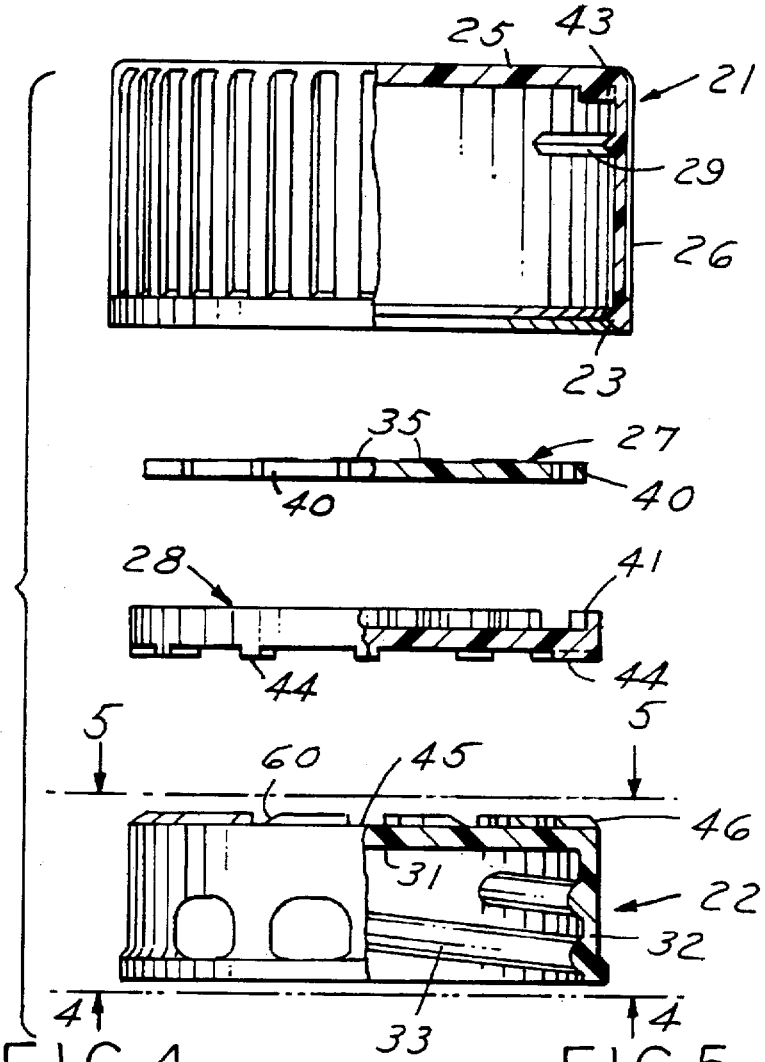
FIG. 3 is a part sectional exploded view of the closure.
Figure 4:
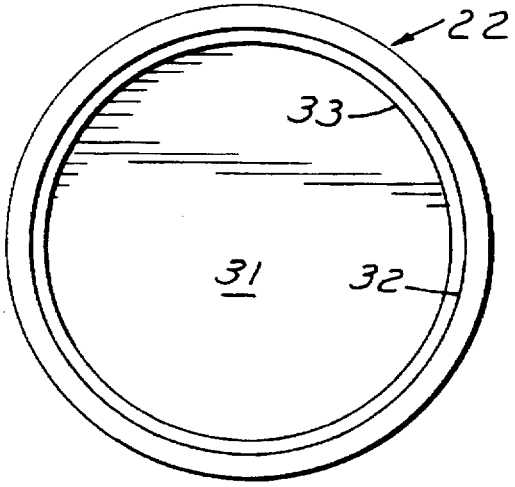
FIG. 4 is a bottom plan view taken along the line 4—4 in FIG. 3.
Figure 5:
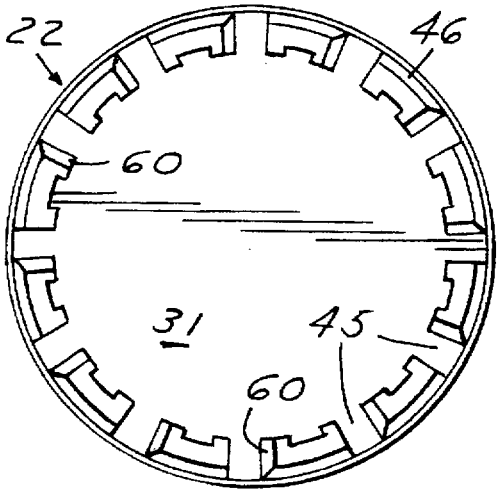
FIG. 5 is a top plan view taken along the line 5—5 in FIG. 3.
Figure 10:
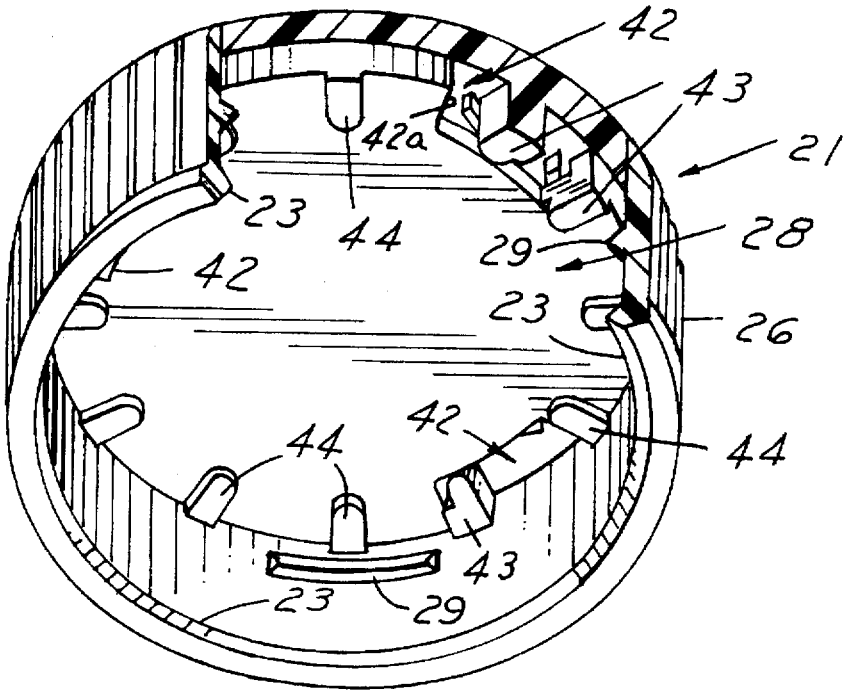
FIG. 10 is a part sectional bottom perspective view of the outer closure showing parts of the day disk and indexing disk in section.

As shown in FIGS. 2–3, and 10 the outer closure member 21 comprises a base wall 25 and a peripheral skirt 26. An assembly of a day disk 27 and an indexing disk 28 is retained against axial movement but permissible rotatable movement with respect to the outer closure member 21 by a segmented annular rib 29 which has an inclined surface which engages the periphery of the indexing disk 28. The inner closure member 22 is of conventional child resistant construction as presently described and includes a base wall 31 and a peripheral skirt 32 having internal threads 33 that are adapted to engage threads 34 on the neck of the container 24. (FIG. 2).

Upon clockwise rotation of the outer closure member 21 combined with axial movement of the outer closure member 21 toward the inner closure member 22, the closure 20 is threaded onto the container. During this rotation, the outer closure rotates with respect to the day disk 27 bringing the succeeding indicia 35 therein into view through the opening 36, as presently described.

Figure 6:
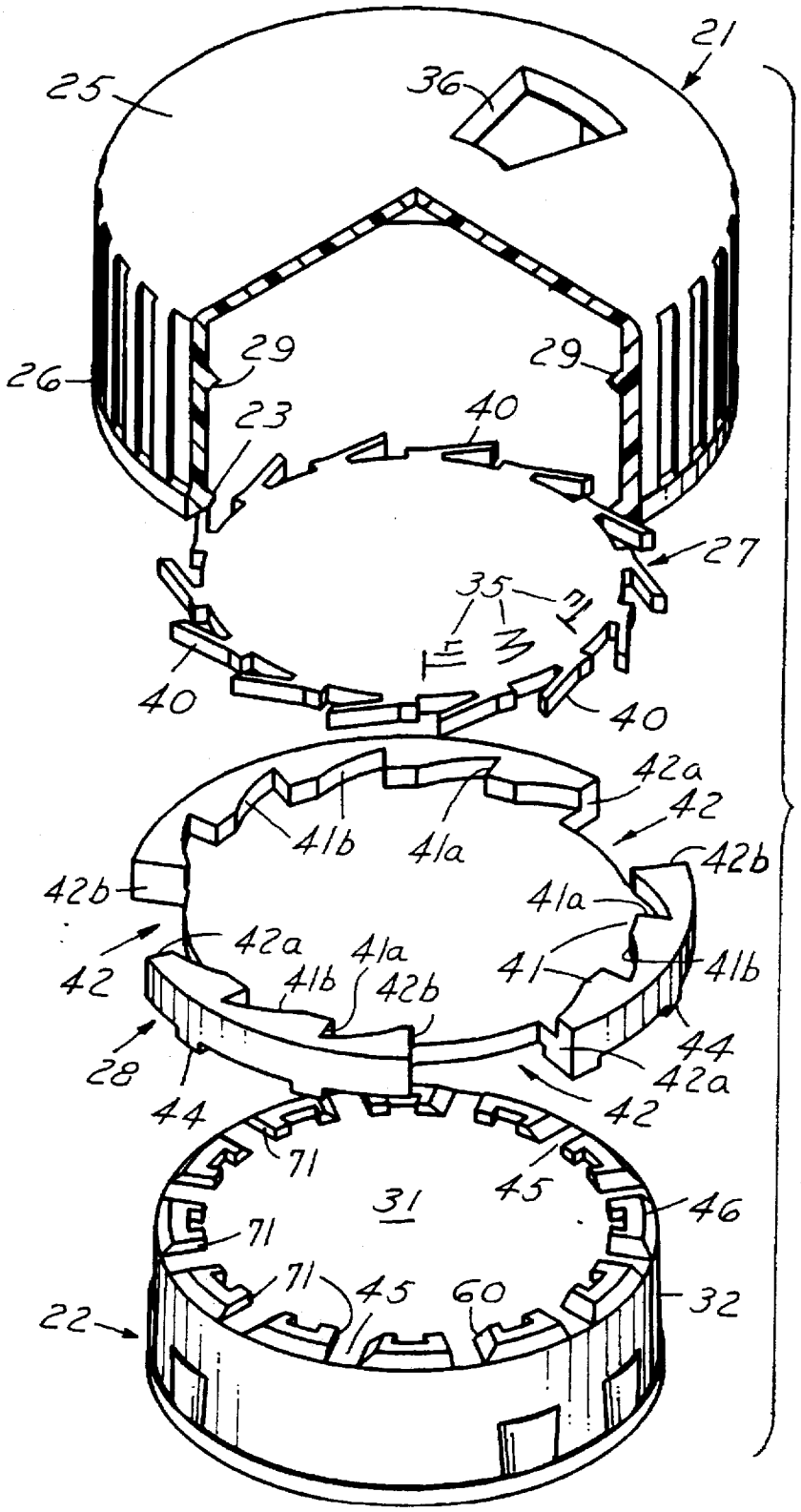
FIG. 6 is a top part sectional exploded perspective view of the closure embodying the invention.
Figure 8:
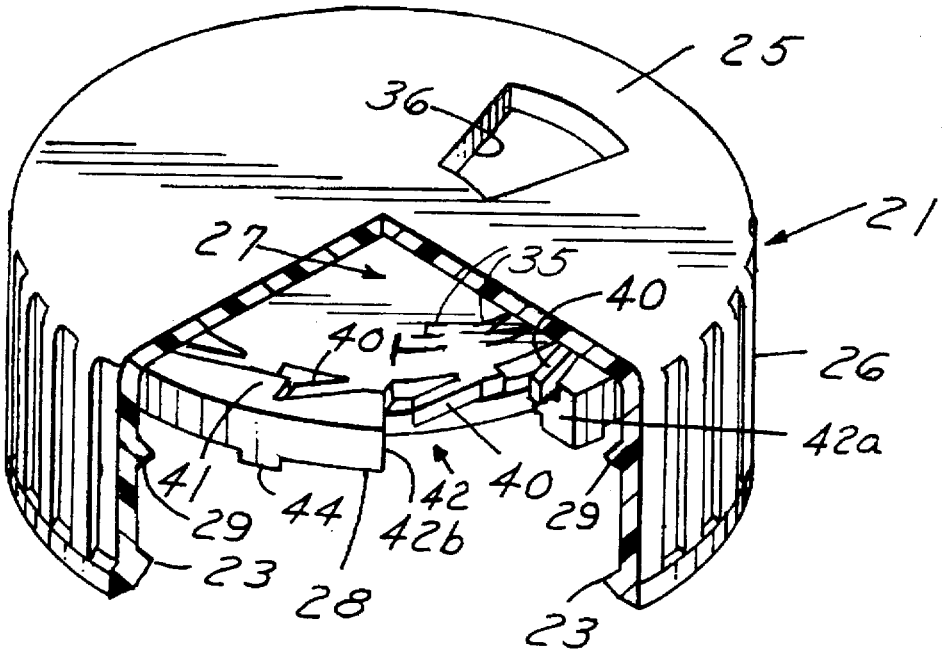
FIG. 8 is a part sectional top perspective view of the outer closure member with the day disk and indexing disk therein.
Figure 11:
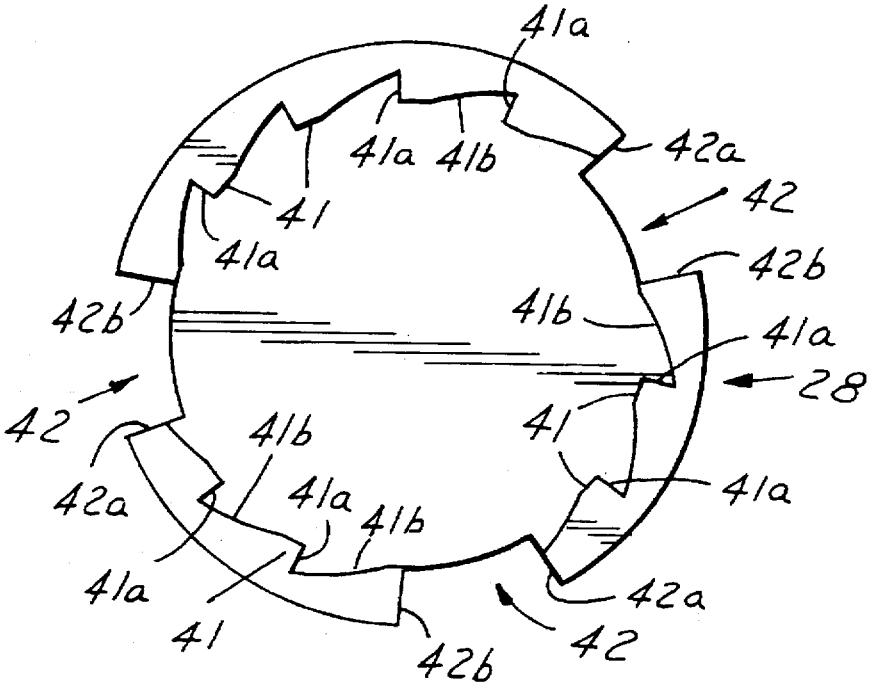
FIG. 11 is a top plan view of the indexing disk.
Figure 12:
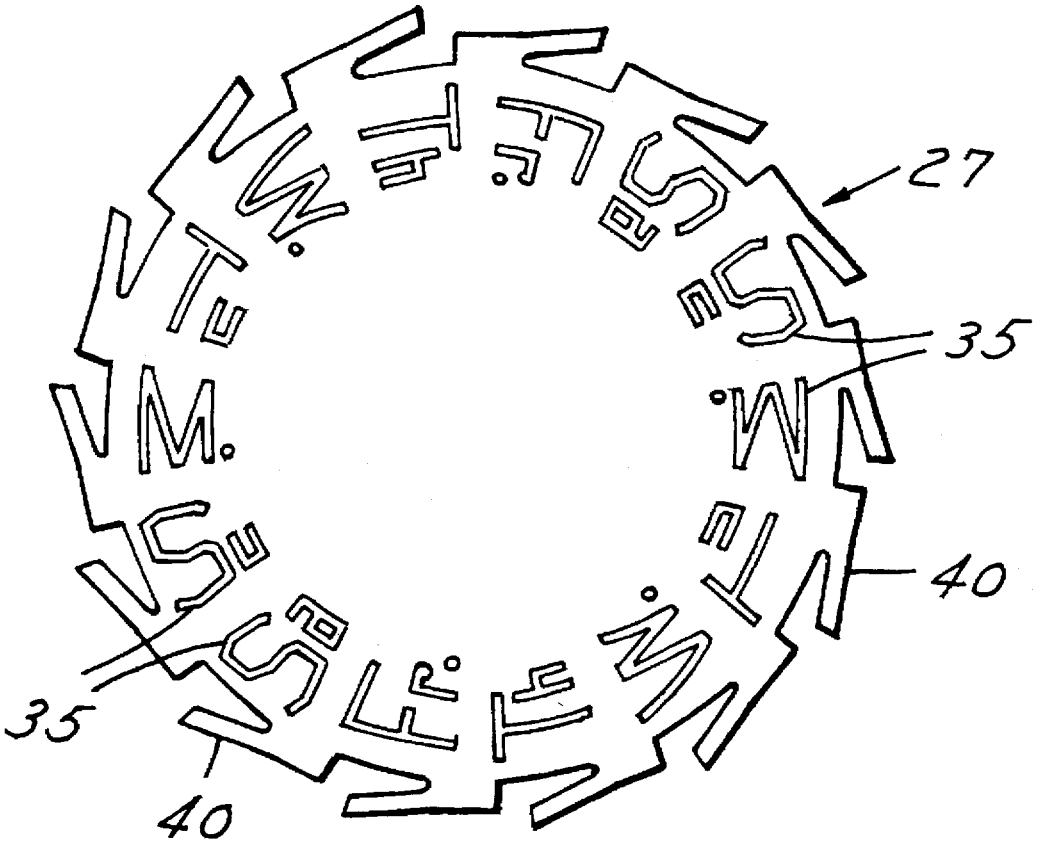
FIG. 12 is a plan view of the day disk.

The day disk 27 has a plurality of equally spaced flexible ratcheting fingers 40 provided on the outer periphery thereof that radially extend clockwise as viewed in FIGS. 6, 8 and 12. Fingers 40 are adapted to engage three rows of circumferentially spaced teeth 41 extending radially inwardly on indexing disk 28. The teeth 41 extend radially inwardly (FIG. 11) and are assymetrical in a counterclockwise direction forming radial surfaces 41*a*.

Figure 9:
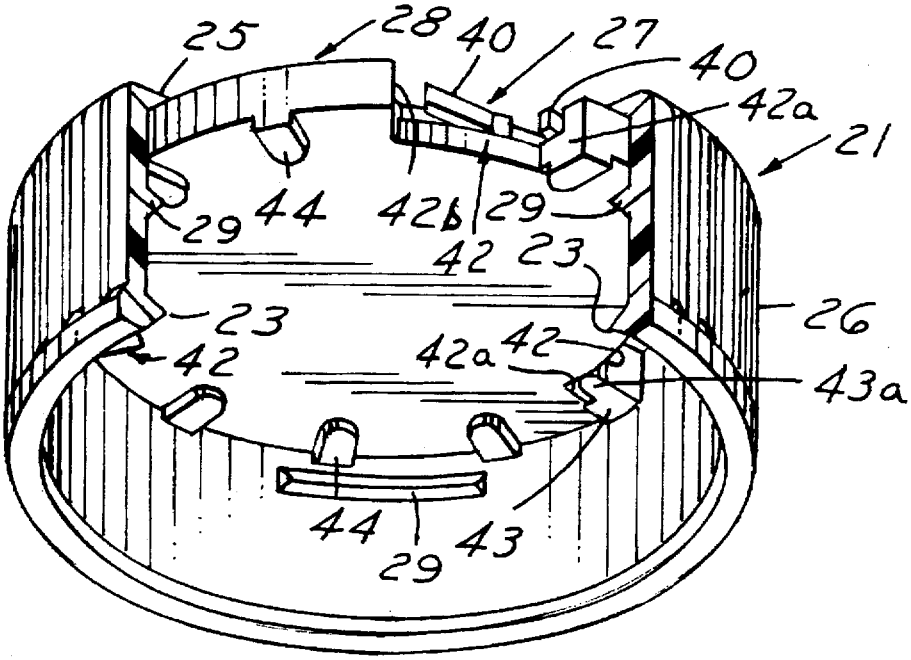
FIG. 9 is a part sectional bottom perspective view of the outer closure member with the indexing disk and day disk thereon.
Figure 15:
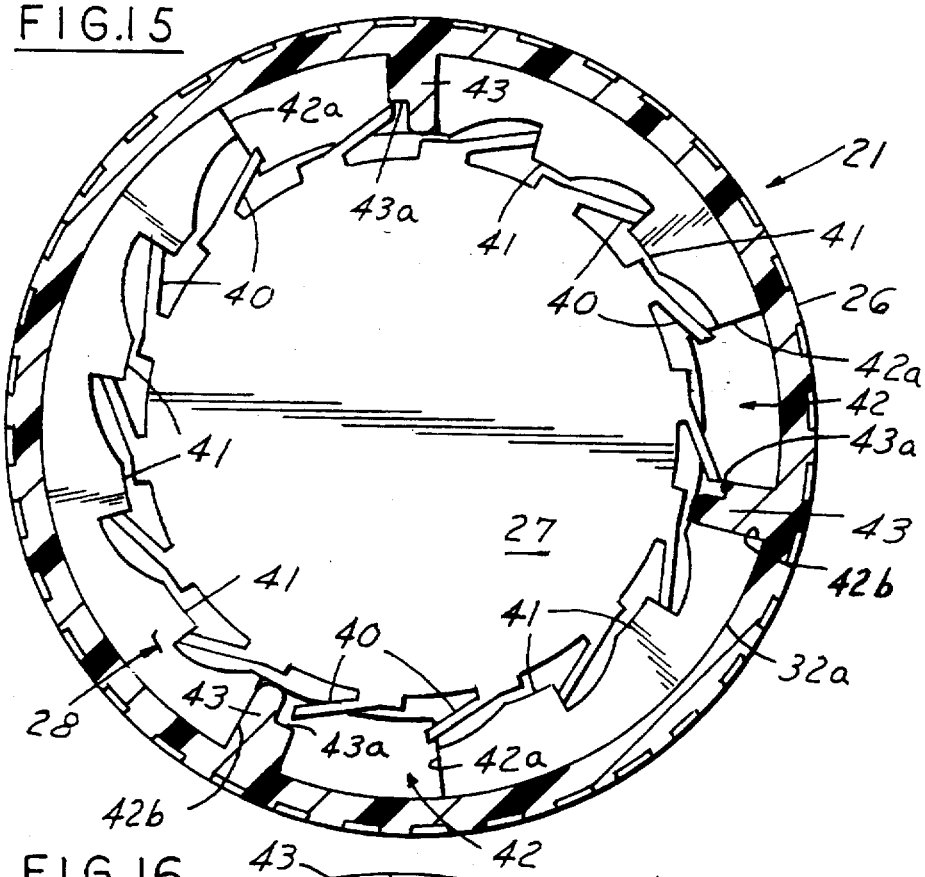
FIG. 15 is a sectional view taken along a line below the base wall of the closure showing the relative position of the parts where the closure is fully applied to a container.

The indexing disk 28 includes circumferentially spaced notches or spaces 42 that are assymetrically positioned relative to one another (FIG. 6). Cogs 43 are located at the juncture of the base wall 25 and peripheral skirt (FIGS. 7, 9, 10) and extend into the notches 42 of the indexing disk 28 which is assembled into the outer closure member 21. The circumferential extent of the notches 42 is such that there is limited relative circumferential movement between the indexing disk 28 and the outer closure member 21 as provided by each cog 43 in a notch 42. Each notch 42 has surfaces 42*a*, 42*b* at the ends thereof (FIG. 11). Each cog 43 includes a radial shoulder 43*a* (FIG. 15).

Figure 7:
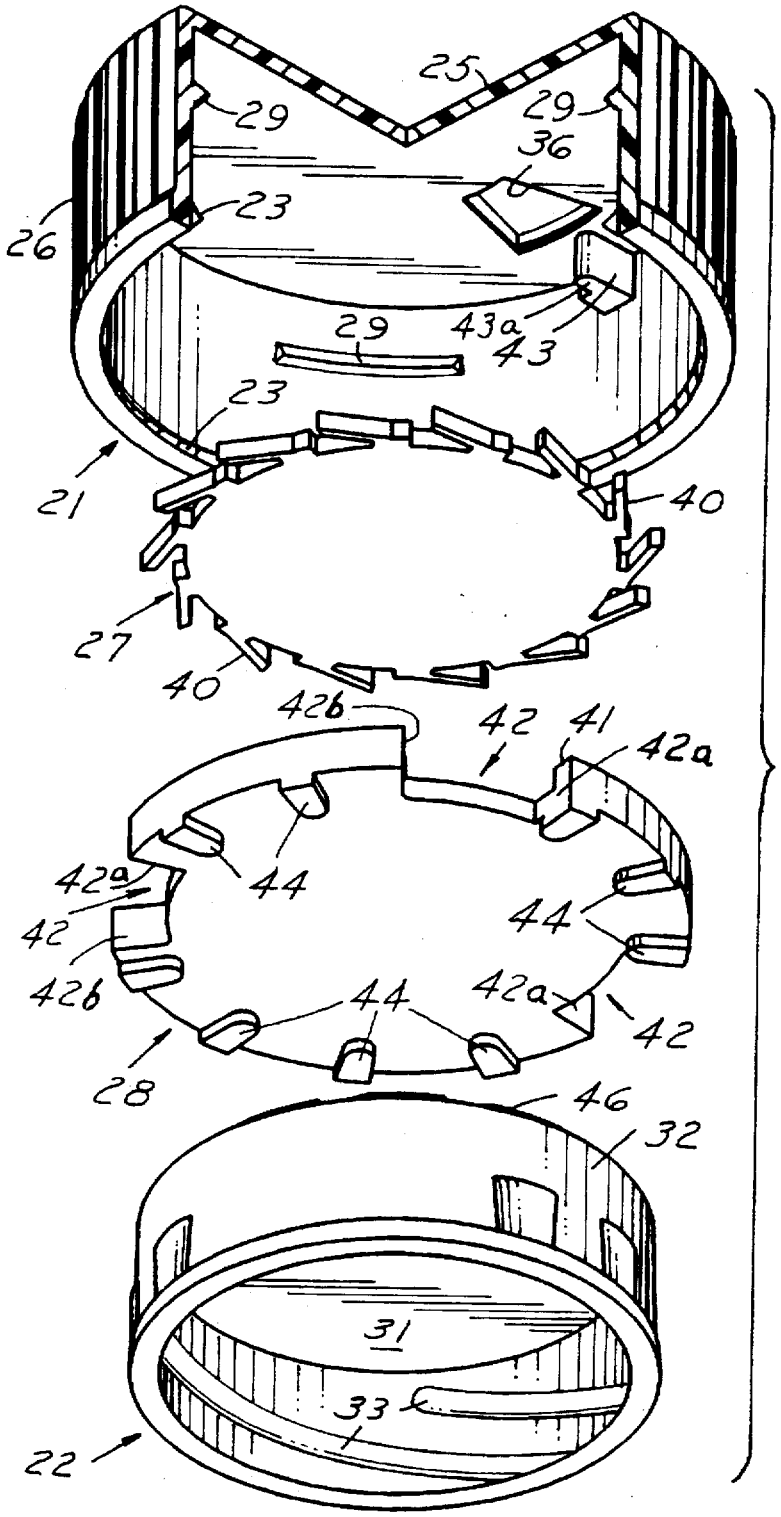
FIG. 7 is a bottom part sectional exploded perspective view of the closure.

As shown in FIG. 7, the indexing disk 28 has circumferentially spaced generally radial projections 44 on the underside thereof adapted to engage in the spaces 45 between circumferentially spaced lugs 46 on the outer surface of the base wall 31 of the inner closure member 22 (FIG. 6), as presently described.

The day disk 27 includes the indicia 35 (FIG. 12) for time, such as the days of the week, or for two sets of days of the week. The indicia 35 are either embossed, debossed or otherwise applied.

The closure components are preferably made of plastic such as polypropylene or polyethylene. The indicia 35 of the day disk 27 preferably have a different color from the day disk 27.

The closure 20 is applied to the container 24 by rotating the closure onto the threads 34 of the container in a clockwise direction. Continued rotation, in a clockwise direction, as viewed from above, tightens the closure 20 on the container 24. Specifically, when applying the closure 20 to the container 24, the outer closure member 21 is rotated in a clockwise direction eventually causing the cogs 43 on its base wall to rotate with respect to the indexing disk 28 until they contact the side end surfaces 42*b* of notches 42 on the indexing disk 28. Further rotation causes the indexing disk 28 to rotate in a clockwise direction bringing projections 44 on its bottom wall into contact with vertical sides 71 of lugs 46 on the base wall 31 of inner closure 22 causing it to turn in a clockwise direction. Continued rotation of outer closure member 21 will cause the inner closure 22 to become tightened into container 24.

Rotation of the outer closure member 21 in a counterclockwise direction will normally merely cause the outer closure member 21 to rotate with respect to the inner closure member 22. This will occur because the rotation of the outer closure member 21 will be transferred from the outer closure member 21 to the indexing disk 28 by the cogs 43 and notches 42; however, counterclockwise rotational force will not be transferred from the indexing disk 28 to the inner closure member 22 without axial engagement between the projections 44 and lugs 46 to rotate the inner closure member 22.

To remove the closure 20 from the container 24, it is necessary to apply downward pressure to member 21 to prevent the outer closure member from moving axially upward when the projections 44 on the indexing disk 28 in the spaces 45 between the lugs 46 on the inner closure member 22 are subjected to rotational torque and would cam up the inclined surfaces 60 if no downward pressure were applied. Upon downward force and counterclockwise rotation of the outer closure member 21, the indexing disk 28 transfers counterclockwise rotational force from the projections 44 to the inner closure member lugs 46 and the closure 20 is rotated such that it is unthread from the container 24. When rotating the closure 20 in the counterclockwise direction from the fully applied position, the outer closure member 21 will rotate with respect to the indexing disk 28 as a cog 43 moves from the side surfaces 42*b* to the removal side surfaces 42*a* in a notch 42. During this rotation, the fingers 40 engage the cogs 43 to rotate the day disk 27 with the outer closure member 22 and keep them stationary relative to each other.

Referring to FIG. 6, the projections 44 on indexing disk 28 contact the lugs 46 on the base wall 31 of inner closure member 22 and will cam up the inclined surface 60 of the succeeding lug 46 unless sufficient axial force is applied to prevent the projections 44 from camming up this inclined surface. When sufficient downward force is exerted the projections 44 will impart rotational torque onto the lugs 46 on the inner closure 22 and cause it to unscrew from the container 24. The construction of such a child resistant feature is like that of U.S. Pat. No. 4,997,096, incorporated herein by reference. Other well known child resistant constructions may also be used such as shown in U.S. Pat. Nos. 4,353,474, 4,371,088, 4,480,759, 4,609,114, 4,947,210, 5,020,681 and U.K. 1,529,999, incorporated herein by reference, each of which functions with relative axial movement and torque between an outer closure member and an inner closure member. As will be apparent to persons skilled in the art, the invention may be readily applied to other child resistant closures which include an outer closure member and inner closure member and interengaging means between the outer closure member and inner closure member to provide a child resistant function.

During application and removal of the closure 20 from the container 24 the angular motion of the cogs 43 on the outer closure 21 is a predetermined angle as the cogs 43 contact the sides **42*a*, 42*b* of notches 42 on the indexing disk 28. For example, if there are 14 indexing positions, then divide 360° by 14, to obtain 25.7. Therefore, the indicia should appear on the day disk 37 at 25.7° intervals and the outer closure member should rotate a minimum of 25.7° each time a change in rotational direction takes place as the cogs 43 rotate from one side of the notches 42 to the other side. This causes the closure 20 to advance one indexing position each time the closure 20 is rotated in the clockwise direction as it is being applied to the container 24**.

Figure 16:
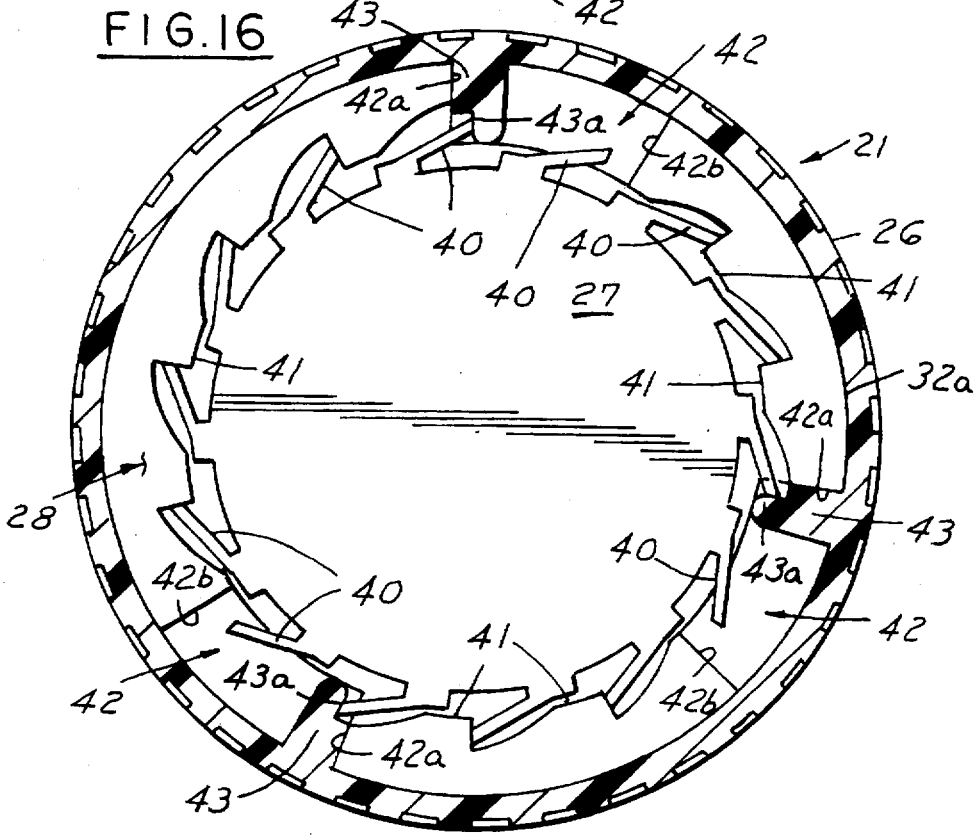
FIG. 16 is a sectional view similar to FIG. 15 showing the relative positions of the parts when the closure is removed from a container.

When the closure is fully removed from a container the parts have the relationship shown in FIG. 16. The cogs 43 are in engagement with end surfaces **42*a* of notches 42 and a finger 40 engages each shoulder 43*a* on each cog 43**.

When the closure is fully applied the parts have the relative positions shown in FIG. 15. The cogs 43 have been moved in the notches 42 to engage the surfaces **42*b*. A finger 40 engages radial surface 41*a* on one of the teeth 41 of each row of teeth 41**.

In moving from the position shown in FIG. 16 to the position shown in FIG. 15 cog 43 moves relative to the day disk 27 past a finger 40 while the remaining fingers 40 are in engagement with teeth 41. The provision of assymetrical teeth 41 having inclined surfaces **41*b* flexes the fingers 40 to facilitate movement of the fingers 40 relative to the teeth 41**.

It can be seen that the fingers 40 engage both the cogs 43 and the indexing disk teeth 41.

Figure 13:
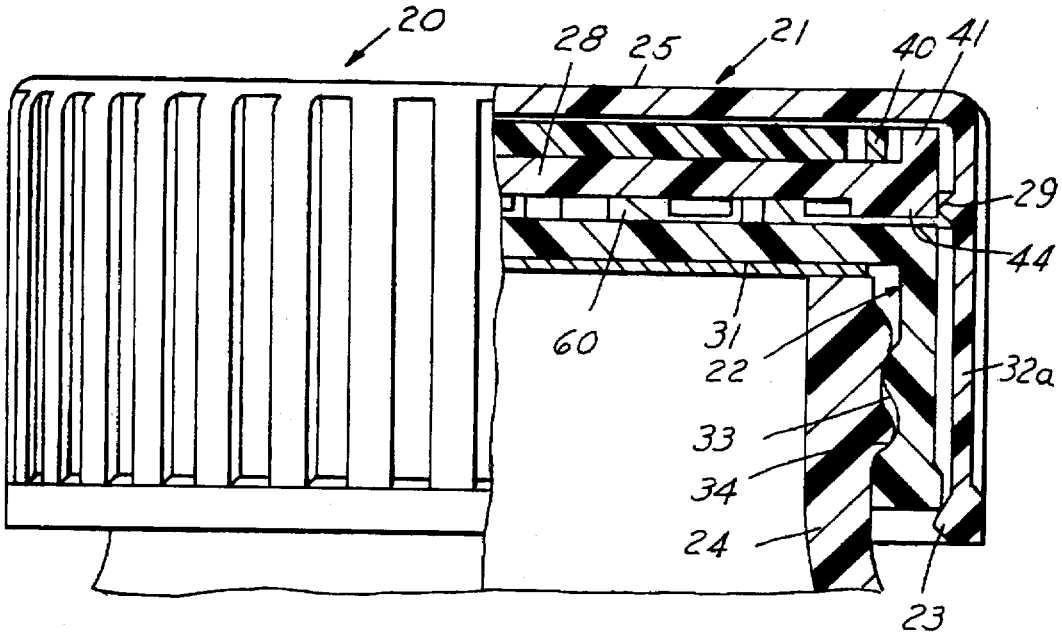
FIG. 13 is a part sectional view on a greatly enlarged scale of a modified closure which is not child resistant.
Figure 14:
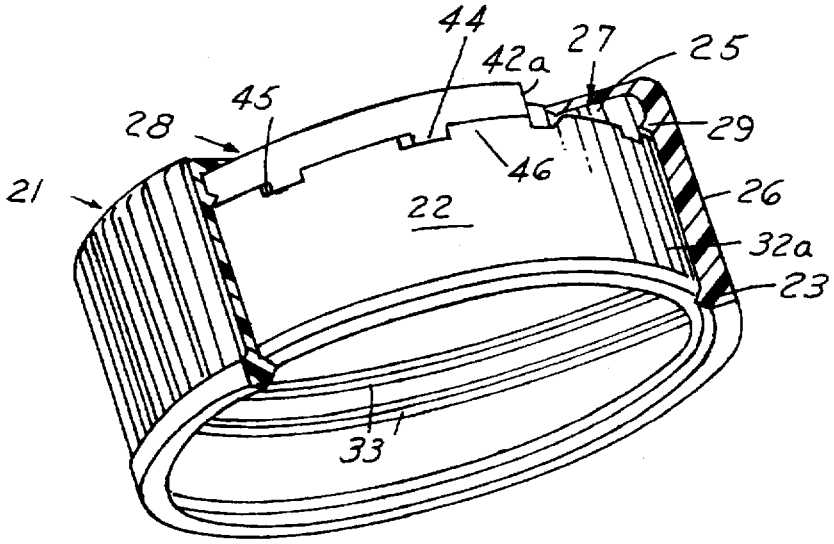
FIG. 14 is a fragmentary perspective part sectional view of the closure shown in FIG. 13.

In the form of the invention shown in FIGS. 13 and 14, the closure is made non-child resistant by reducing the height of the skirt **32*a* so that there is no axial disengagement of the projections 44 and lugs 46**. In all other respects, the closure is the same.

It can thus be seen that there has been provided a child resistant reminder closure of the type shown in U.S. Pat. No. 5,184,739 which can be more readily made and assembled and which can be readily made to function as a reminder during either removal or application of the closure to a container.

I claim:

1. A child resistant reminder closure comprising an outer closure member having a base wall and a peripheral skirt, an inner closure member having a base wall and a peripheral skirt, interengaging means on the outer closure member to retain the inner closure member against axially outward movement relative to the outer closure member, said outer closure member and said inner closure member having limited axial movement relative to one another, a day disk, said day disk being provided adjacent the inner surface of the base wall of the outer closure member, an indexing disk being provided adjacent said day disk, said day disk having a set of flexible radial ratcheting means extending radially outwardly from the day disk, a first set of engaging means on said outer closure member, a second set of engaging means on said indexing disk engagable with said first set of engaging means said outer closure member, said first set and said second set of engaging means being constructed and arranged to permit limited relative rotation between said outer closure member and said indexing disk, said indexing disk having a third set of engaging means, said flexible radial ratcheting means alternately engaging said first set and said third set of engaging means such that the day disk is rotated in one direction only as the outer closure member is alternately rotated in a clockwise and counterclockwise direction, a set of interengagable means between said indexing disk and said inner closure member being engaged by relative axial movement, said day disk having circumferentially spaced indicia thereon, said base wall of said outer closure member having an opening adapted to be selectively aligned with said indicia on said day disk, interengaging means on the inner closure member adapted to engage means on a container by relative rotation of said inner closure member and a container, such that when the outer closure member is moved axially toward the inner closure member, the closure can be removed from a container.

2. The child resistant reminder closure set forth in claim 1 wherein said flexible radial ratcheting means on said day disk comprise flexible fingers extending circumferentially in one direction and having free ends.

3. The child resistant reminder closure set forth in claim 2 wherein said first set of engaging means on said outer closure member comprises a set of cogs on said outer closure member positioned at the juncture of the base wall and peripheral skirt of said outer closure member, said second set of engaging means on said indexing disk comprising notches positioned on the periphery of said indexing disk, said cogs on said outer closure member being adapted to engage said notches on said indexing disk when the outer closure member is rotated in either direction.

4. The child resistant reminder closure set forth in claim 3 wherein said third set of means on said indexing disk engaging with said flexible fingers on said day disk comprise teeth on said indexing disk extending radially inwardly and engaging the free ends of the set of flexible fingers.

5. The child resistant reminder closure set forth in any one of claims 1–4 wherein said day disk is positioned such that said ratcheting means extend circumferentially and such that said day disk is rotated relative to said outer closure member on removal of the closure.

6. The child resistant reminder closure set forth in any one of claims 1–4 wherein said day disk is positioned such that said flexible ratcheting means on said day disk extend circumferentially and such that said day disk is rotated relative to said outer closure member on application of the closure.

7. A reminder closure comprising an outer closure member having a base wall and a peripheral skirt, an inner closure member having a base wall and a peripheral skirt, interengaging means on the outer closure member to retain the inner closure member against axially outward movement relative to the outer closure member, a day disk, said day disk being provided adjacent the inner surface of the base wall of the outer closure member, an indexing disk being provided adjacent said day disk, said day disk having a set of flexible radial ratcheting means extending radially outwardly from the day disk, a first set of engaging means on said outer closure member, a second set of engagable means on said indexing disk engagable with said first set of engaging means on said outer closure member, said first set and said second set of engaging means being constructed and arranged to permit limited relative rotation between said outer closure member and said indexing disk, said indexing disk having a third set of engaging means, said flexible radial ratcheting means alternately engaging said first set and said third set of engaging means such that the day disk is rotated in one direction only as the outer closure member is alternately rotated in a clockwise and counterclockwise direction, a set of interengagable means between said indexing disk and said inner closure member, said day disk having circumferentially spaced indicia thereon, said base wall of said outer closure member having an opening adapted to be selectively aligned with said indicia on said day disk, interengaging means on the inner closure member adapted to engage means on a container by relative rotation of said inner closure member and a container, such that when the outer closure member is rotated, the closure can be removed from a container.

8. The reminder closure set forth in claim 7 wherein said flexible radial ratcheting means on said day disk comprise flexible fingers extending circumferentially in one direction and having free ends.

9. The reminder closure set forth in claim 8 wherein said first set of engaging means on said outer closure member comprises a set of cogs on said outer closure member positioned at the juncture of the base wall and peripheral skirt of said outer closure member, said second set of engaging means on said indexing disk comprising notches positioned on the periphery of said indexing disk, said cogs on said outer closure member being adapted to engage said notches on said indexing disk when the outer closure member is rotated in either direction.

10. The reminder closure set forth in claim 9 wherein said third set of means on said indexing disk engage with the set of flexible fingers on said day disk comprise teeth on said indexing disk extending radially inwardly and engaging the free ends of the set of flexible fingers.

11. The reminder closure set forth in any one of claims 9–10 wherein said day disk is positioned such that said ratcheting means extend circumferentially and such that said day disk is rotated relative to said outer closure member on removal of the closure.

12. The reminder closure set forth in any one of claims 7–10 wherein said day disk is positioned such that flexible ratcheting means on said day disk extend circumferentially and such that said day disk is rotated relative to said outer closure member on application of the closure.

13. A child resistant reminder closure comprising an outer closure member having a base wall and a peripheral skirt, an inner closure member having a base wall and a peripheral skirt, interengaging means between the outer closure member and inner closure member to retain the inner closure member against axially outward movement relative to the outer closure member, said outer closure member and said inner closure member having limited axial movement relative to one another, a day disk, said day disk being provided adjacent the inner surface of the base wall of the outer closure member, an indexing disk being provided adjacent said day disk, said day disk having a set of flexible radial ratcheting means extending radially outwardly from the day disk, a first set of engaging means on said outer closure member, a second set of engaging means on said indexing disk engagable with said first set of engaging means said outer closure member, said first set and said second set of engaging means being constructed and arranged to permit limited relative rotation between said outer closure member and said indexing disk, said indexing disk having a third set of engaging means engagable with said flexible ratcheting means on said day disk, a set of interengagable means between said indexing disk and said inner closure member being engaged by relative axial movement, said day disk having circumferentially spaced indicia thereon, said base wall of said outer closure member having an opening adapted to be selectively aligned with said indicia or said day disk, interengaging means on the inner closure member adapted to engage means on a container by relative rotation of said inner closure member and a container, such that when the outer closure member is moved axially to engage the inner closure member, the closure can be removed from a container and said day disk can be rotated relative to said outer closure member in one mode during application of the closure to a container and in another mode during removal of the closure from a container to bring different indicia into view through the opening, said flexible radial ratcheting means on said day disk comprising flexible fingers extending circumferentially in one direction and having free ends, said first set of engaging means on said outer closure member comprising a set of cogs on said outer closure member positioned at the juncture of the base wall and peripheral skirt of said outer closure member, said second set of engaging means on said indexing disk comprising notches positioned on the periphery of said indexing disk, said cogs on said outer closure member being adapted to engage said notches on said indexing disk when the outer closure member is rotated in either direction, said third set of means on said indexing disk engaging with said flexible fingers on said day disk comprising teeth on said indexing disk extending radially inwardly and engaging the free ends of the set of flexible fingers, and each said cogs including a shoulder engagable with a flexible finger.

14. The child resistant reminder closure set forth in claim 13 wherein said day disk is positioned such that said ratcheting means extend circumferentially and such that said day disk is rotated relative to said outer closure member on removal of the closure.

15. The child resistant reminder closure set forth in claim 13 wherein said day disk is positioned such that said flexible ratcheting means on said day disk extend circumferentially and such that said day disk is rotated relative to said outer closure member on application of the closure.

16. A reminder closure comprising an outer closure member having a base wall and a peripheral skirt, an inner closure member having a base wall and a peripheral skirt, interengaging means between the outer closure member and inner closure member to retain the inner closure member against axially outward movement relative to the outer closure member, a day disk, said day disk being provided adjacent the inner surface of the base wall of the outer closure member, an indexing disk being provided adjacent said day disk, said day disk having a set of flexible radial ratcheting means extending radially outwardly from the day disk, a first set of engaging means on said outer closure member, a second set of engagable means on said indexing disk engagable with said first set of engaging means on said outer closure member, said first set and said second set of engaging means being constructed and arranged to permit limited relative rotation between said outer closure member and said indexing disk, said indexing disk having a third set of engaging means engagable with said flexible ratcheting means on said day disk, a set of interengagable means between said indexing disk and said inner closure member, said day disk having circumferentially spaced indicia thereon, said base wall of said outer closure member having an opening adapted to be selectively aligned with said indicia on said day disk, interengaging means on the inner closure member adapted to engage means on a container by relative rotation of said inner closure member and a container, such that when the outer closure member is rotated, the closure can be removed from a container and said day disk can be rotated relative to said outer closure member in one mode during application of the closure to a container and in another mode during removal of the closure to a container to bring different indicia into view through the opening, said flexible radial ratcheting means on said day disk comprising flexible fingers extending circumferentially in one direction and having free ends, said first set of engaging means on said outer closure member comprising a set of cogs on said outer closure member positioned at the juncture of the base wall and peripheral skirt of said outer closure member, said second set of engaging means on said indexing disk comprising notches positioned on the periphery of said indexing disk, said cogs on said outer closure member being adapted to engage said notches on said indexing disk when the outer closure member is rotated in either direction, said third set of means on said indexing disk engage with the set of flexible fingers on said day disk comprising teeth on said indexing disk extending radially inwardly and engaging the free ends of the set of flexible fingers, and each said cog includes a shoulder engagable with a flexible finger.

17. The reminder closure set forth in claim 16 wherein said day disk is positioned such that said ratcheting means extend circumferentially and such that said day disk is rotated relative to said outer closure member on removal of the closure.

18. The reminder closure set forth in claim 16 wherein said day disk is positioned such that flexible ratcheting means on said day disk extend circumferentially and such that said day disk is rotated relative to said outer closure member on application of the closure.

* * * * *